United States Patent [19]

Bahr

[11] 4,335,817

[45] Jun. 22, 1982

[54] EASY OPENABLE AND CLOSABLE BAG WITH SLIDE FASTENER

[75] Inventor: Karl E. Bahr, Meadville, Pa.

[73] Assignee: Talon, Inc., Meadville, Pa.

[21] Appl. No.: 119,056

[22] Filed: Feb. 6, 1980

[51] Int. Cl.[3] ..... B65D 17/00

[52] U.S. Cl. ..... 206/610; 206/260; 229/62

[58] Field of Search ..... 229/62; 150/3; 206/260, 206/267, 610, 611

[56] References Cited

U.S. PATENT DOCUMENTS

| | | | |
|---|---|---|---|
| 1,939,794 | 12/1933 | Seybold et al. | 206/628 X |
| 2,519,290 | 8/1950 | Saltz | 150/3 |
| 2,617,573 | 11/1952 | Nahoom | 150/3 X |
| 2,807,265 | 9/1957 | Oliva et al. . | |
| 3,102,570 | 9/1963 | Fairchilds | 150/3 |
| 3,619,395 | 11/1971 | Skendzic | 150/3 |
| 3,625,270 | 12/1971 | Skendric | 150/3 |
| 3,637,000 | 1/1972 | Walger et al. | 150/3 |
| 3,712,531 | 1/1973 | McCall | 206/628 X |
| 3,727,829 | 4/1973 | Hüni | 229/62 |
| 3,755,993 | 9/1973 | Cote | 229/62 X |
| 3,780,781 | 12/1973 | Uramoto | 150/3 |

FOREIGN PATENT DOCUMENTS

| | | | |
|---|---|---|---|
| 1247945 | 10/1960 | France | 150/3 |

*Primary Examiner*—Stephen P. Garbe
*Attorney, Agent, or Firm*—Anthony O'Brien

[57] ABSTRACT

A reclosable bag has elongated opening means adapted to be permanently opened with a slide fastener having support tapes secured to the bag on respective opposite sides of the opening means for forming a closure over the opening means once the opening means have been permanently opened.

4 Claims, 2 Drawing Figures

EASY OPENABLE AND CLOSABLE BAG WITH SLIDE FASTENER

TECHNICAL FIELD

The present invention relates to bags for containing, shipping, storing and otherwise handling bulk material such as pet food, charcoal, pet bedding, etc.

DESCRIPTION OF THE PRIOR ART

Bulk materials such as pet food, charcoal, pet bedding, etc., are often sold in paper or polymer bags. When it is desired to use the product within a bag, the bag is cut or ripped open to enable the contents to be removed by pouring or otherwise. Once the bag has been opened, there are no provisions for reclosing the opening, and thus extra care or steps must be taken in subsequent handling of the bag to avoid loss or contamination through the opening.

Special purpose bags, such as a ring binder pocket disclosed in U.S. Pat. No. 2,807,265, have been manufactured with an opening to which a slide fastener is attached so that the bag may be easily closed and opened. However, bulk material exerts pressure forces on the walls and seams of a bag during shipping and handling. Such forces could cause a slide fastener to open or otherwise fail, particularly when the slide fastener is formed from relatively inexpensive materials in order to avoid greatly adding to the cost of the bag and its contents.

A tobacco pocket is known from U.S. Pat. No. 2,519,290 wherein a slide fastener forms an auxiliary closure for a primary sealing device which includes complementary rib and groove members. Such rib and groove members are generally unable to withstand the pressure forces of bulk materials in larger bags.

A plastic bag having adjacent side walls sealed at the ends thereof is illustrated in U.S. Pat. No. 3,619,395 wherein a pair of cooperating elongated parallel transversely closable and releasable interlocking members are formed on the inner surfaces of the respective side walls. Access to the interlocking means is provided by a tear ribbon on one of the side walls.

SUMMARY OF THE INVENTION

The invention is summarized in a reclosable bag including a bag having an elongated opening means formed therein adapted to be permanently opened, and a slide fastener having a pair of support tapes and a pair of rows of interlocking coupling elements extending from inner edges of the respective support tapes, the support tapes being secured to the bag on respective opposite sides of the opening means for forming a closure over the opening means.

An object of the invention is to construct a reclosable bag having a slide fastener for enabling reclosure thereof wherein the slide fastener is normally shielded from lateral stress and abrasion during filling, shipping and storing of the bag until the bag is opened for consumer use.

One advantage of the invention is that the bag has opening means which is normally closed so that such opening means in the bag structure absorbs substantially all of the stress from shifting and handling of the bulk material in the bag.

Other objects, advantages and features of the invention will be apparent from the following description of the preferred embodiment taken in conjunction with the accompanying drawings.

DESCRIPTION OF THE PREFERRED EMBODIMENT

Figure 1:
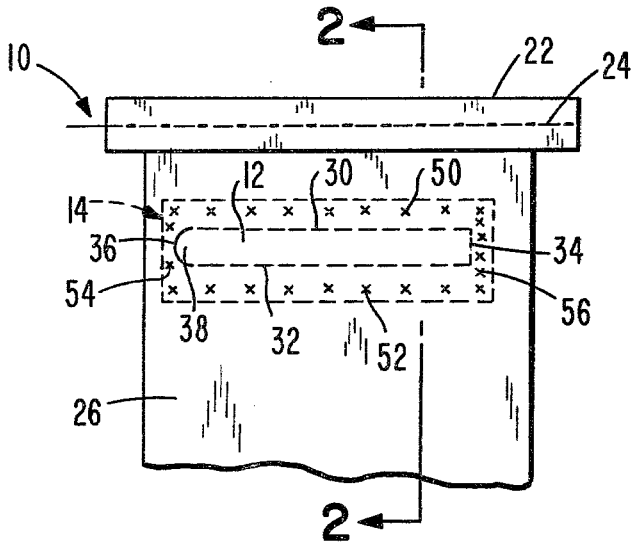
FIG. 1 is a plan view of a top portion of a bag constructed in accordance with the invention.
Figure 2:
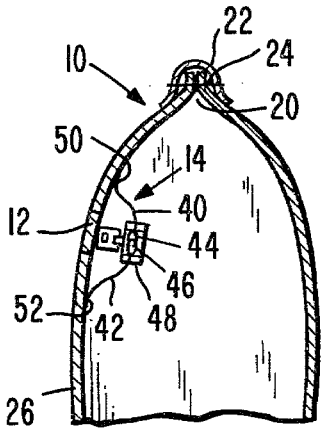
FIG. 2 is a cross-section taken at line 2—2 in FIG. 1.

As illustrated in FIGS. 1 and 2, an embodiment of the invention includes a bag indicated generally at 10 with an elongated opening means, such as a tear strip 12, covered by a slide fastener indicated generally at 14. The bag 10 is used for storing, shipping and otherwise handling bulk particulate or powder material. Once the bag is purchased by the user of the material therein, the tear strip 12 may be removed and the slide fastener 14 be used as a reclosable opener to permit removal of a small quantity of material from the bag 10 and storing the remaining material for later use.

The bag 10 is a conventional bag made from conventional materials such as paper and/or polymer used in shipping and storing bulk particulate or powder material. The bag 10 has a top opening 20 closed by a conventional strip 22 and line of stiching 24. The tear strip 12 is formed in a sidewall 26 of the bag 10 by perforated lines 30 and 32 which extend parallel to each other across the wall 26, a perforated line 34 extending between the ends of the lines 30 and 32 and a semi-circular cut line 36 extending between the opposite ends of the lines 30 and 32 to form a tab 38 which may be easily gripped for removing the tear strip 12.

The slide fastener 14 includes a pair of tapes 40 and 42 and a pair of rows of interlocking coupling elements 44 and 46 extending from the inner edges of the respective tapes 40 and 42. A slider 48 is slidably mounted on the rows of coupling elements 44 and 46 for engaging and disengaging the coupling elements 44 and 46 by movement of the slider. The slide fastener is conventional, and preferably of a relatively inexpensive type, such as a slide fastener having coupling elements 44 and 46 formed from spiral coil type elements which are installed through slits in folded polymer film tapes forming the support tapes 40 and 42.

Outer edge portions of the respective tapes 40 and 42 are secured to the inside surface of the wall 26 on opposite sides of the elongated tear strip 12 along lines of x's 50 and 52. At the ends of the slide fastener, lines of x's 54 and 56 illustrate transverse lines of attachment of the tapes 40 and 42 to the wall 26 past the ends of the tear strip 12. The attachments formed between the slide fastener tapes and the inside surface of the wall 26 are made by bonding, sewing, etc. The width of the slide fastener 14 between the attachments 50 and 52 is greater than the width of the section of bag wall 26 between the attachments 50 and 52 so that the slide fastener is stress free or in a relaxed condition while the tear strip 12 remains intact.

In use of the bag shown in FIGS. 1 and 2, the bag is initially manufactured without the sealing strip 22 and stitching line 24 but with the slide fastener attached thereto in a relaxed condition. Subsequently the bag is filled through the opening 20 with particulate or powder material and then the strip 22 is sewn on the upper edge of the bag by the stitches 24 to close the bag. Thereafter the bag and its contents can be stored, stacked with other bags, shipped, or otherwise handled until the bag and its contents reach the user.

During the filling, stacking and shipping of the bag with its contents, the tear strip 12 remains intact absorbing the forces exerted on the bag by the pressure of the bulk material within the bag. The slide fastener 14 is thus relieved of stress from the pressure of the contents during the filling, shipping, handling, and storing of the bag which otherwise could cause failure of the slide fastener.

Once the bag and its contents reach the user, the user can grasp the tab 38 and remove the tear strip 12 exposing the slide fastener 14. Thereafter the bag can be opened by movement of the slider 48 to permit a desired quantity of the material within the bag 10 to be removed. After the removal of the desired quantity of material, the slider 48 is again operated to reclose the bag. In bags without any provisions for reclosing, the unused contents of a bag are subject to becoming contaminated and being inadvertently spilled through the opening.

Furthermore, the slide fastener does not affect the storing or filling characteristics of the bag due to its being entirely placed on a side wall of the bag.

Since the present invention is subject to many variations, modifications and changes in detail, it is intended that all matter described in the foregoing description and shown in the accompanying drawings be interpreted as illustrative and not in a limiting sense.

What is claimed is:

1. A reclosable bag comprising a bag having a top opening, means for closing the top opening, and a sidewall, said bag also having elongated closed opening means including a closed tear strip formed in the sidewall and adapted to be permanently opened, and a slide fastener having a pair of support tapes and a pair of rows of interlocking coupling elements extending from inner edges of the respective support tapes, said support tapes being secured to the sidewall on respective opposite sides of the tear strip for forming a closure for the opening means after the tear strip has been opened.

2. A reclosable bag as claimed in claim 1 wherein the tear strip is formed by a pair of parallel lines of perforations in the sidewall, a third line of perforations in the sidewall extending between the parallel lines of perforations at one end of the tear strip, and a curved cut line in the sidewall extending between the parallel lines of perforations at the other end of the tear strip.

3. A reclosable bag as claimed in claim 1 or 2 wherein the support tapes are secured to an inside surface of the bag.

4. A reclosable bag as claimed in claim 1 or 2 wherein said support tapes have outer edge portions which are secured to an inside surface of the sidewall on respective opposite sides of the tear strip, and the width of the slide fastener between the outer edge portions is greater than the sidewall portion between the attachments to the support tapes so that the slide fastener is free of stress prior to the tear strip being permanently opened.

* * * * *